US011152014B2

(12) United States Patent
Wang

(10) Patent No.: US 11,152,014 B2
(45) Date of Patent: Oct. 19, 2021

(54) AUDIO SOURCE PARAMETERIZATION

(71) Applicant: Dolby Laboratories Licensing Corporation, San Francisco, CA (US)

(72) Inventor: Jun Wang, Beijing (CN)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 355 days.

(21) Appl. No.: 16/090,739

(22) PCT Filed: Apr. 5, 2017

(86) PCT No.: PCT/US2017/026235
§ 371 (c)(1),
(2) Date: Oct. 2, 2018

(87) PCT Pub. No.: WO2017/176941
PCT Pub. Date: Oct. 12, 2017

(65) Prior Publication Data

US 2020/0327897 A1 Oct. 15, 2020

Related U.S. Application Data

(60) Provisional application No. 62/337,517, filed on May 17, 2016.

(30) Foreign Application Priority Data

Apr. 8, 2016 (WO) ..... PCT/CN2016/078813
May 20, 2016 (EP) ..... 16170720

(51) Int. Cl.
*G10L 21/0308* (2013.01)
*G10L 21/0272* (2013.01)
(Continued)

(52) U.S. Cl.
CPC ..... *G10L 21/0308* (2013.01); *G10L 19/08* (2013.01); *H04S 3/008* (2013.01); *H04S 2400/11* (2013.01); *H04S 2400/15* (2013.01)

(58) Field of Classification Search
CPC ..... G10L 21/0272; G10L 21/028; G10L 21/0308; G10L 21/0232; G10L 15/02;
(Continued)

(56) References Cited

U.S. PATENT DOCUMENTS 6,622,117 B2 9/2003 Deligne
8,200,484 B2 6/2012 Choi
(Continued)

FOREIGN PATENT DOCUMENTS

CN 104103277 10/2014
GB 2510650 8/2014
(Continued)

OTHER PUBLICATIONS

Latif et al, "Partially Constrained Blind Source Separation for Localization of Unknown Sources Exploiting Non-homogeneity of the Head Tissues", Journal of VLSI Signal Processing 49, p. 217-232, (Year: 2007).*
(Continued)

*Primary Examiner* — Leshui Zhang

(57) ABSTRACT

The present document describes a method (600) for estimating source parameters of audio sources (101) from mix audio signals (102), with. The mix audio signals (102) comprise a plurality of frames. The mix audio signals (102) are representable as a mix audio matrix in a frequency domain and the audio sources (101) are representable as a source matrix in the frequency domain. The method (600) comprises updating (601) an un-mixing matrix (221) which is configured to provide an estimate of the source matrix from the mix audio matrix, based on a mixing matrix (225)
(Continued)

which is configured to provide an estimate of the mix audio matrix from the source matrix. Furthermore, the method (600) comprises updating (602) the mixing matrix (225) based on the un-mixing matrix (221) and based on the mix audio signals (102). In addition, the method (600) comprises iterating (603) the updating steps (601, 602) until an overall convergence criteria is met.

24 Claims, 6 Drawing Sheets

(51) Int. Cl.
*G10L 19/08* (2013.01)
*H04S 3/00* (2006.01)

(58) Field of Classification Search
CPC ..... G10L 15/14; G10L 19/008; G10L 19/02; G10L 19/08; G10L 19/00; H04S 3/008; H04S 2400/15; H04S 2400/11; H04S 3/00; G06F 3/16
USPC ..... 381/17, 18, 94.3; 700/94
See application file for complete search history.

(56) References Cited

U.S. PATENT DOCUMENTS

| | | | |
|---|---|---|---|
| 8,355,509 | B2 | 1/2013 | Faller |
| 8,358,563 | B2 | 1/2013 | Hiroe |
| 8,363,865 | B1 | 1/2013 | Bottum |
| 8,874,439 | B2 | 10/2014 | Kim |
| 8,880,395 | B2 | 11/2014 | Yoo |
| 8,958,750 | B1 | 2/2015 | Saleem |
| 9,031,816 | B2 | 5/2015 | Chen |
| 9,099,096 | B2 | 8/2015 | Yoo |
| 2009/0086998 | A1 | 4/2009 | Jeong |
| 2010/0082340 | A1 | 4/2010 | Nakadai |
| 2013/0297298 | A1 | 11/2013 | Yoo |
| 2014/0058736 | A1 | 2/2014 | Taniguchi |
| 2015/0213806 | A1 | 7/2015 | Disch |
| 2015/0256956 | A1 | 9/2015 | Jensen |
| 2016/0029121 | A1 | 1/2016 | Nesta |
| 2017/0365273 | A1 | 12/2017 | Wang |

FOREIGN PATENT DOCUMENTS

| | | |
|---|---|---|
| GB | 2516483 | 1/2015 |
| RS | 1332 U | 8/2013 |
| WO | 2013/053631 | 4/2013 |
| WO | 2014/147442 | 9/2014 |
| WO | 2014/179308 | 11/2014 |
| WO | 2014/195132 | 12/2014 |
| WO | 2015/081070 | 6/2015 |
| WO | 2016/011048 | 1/2016 |
| WO | 2016/014815 | 1/2016 |
| WO | 2016/130885 | 8/2016 |
| WO | 2016/133785 | 8/2016 |

OTHER PUBLICATIONS

Saito et al, "Convolutive Blind Source Separation Using an Iterative Least-Square Algorithm for Non-Orthogonal Approximate Joint Diagonalization", IEEE/ACM Transactions on Audio, Speech, and Language Processing, vol. 23, No. 12, p. 2434-2448, Dec. 2015.*
Chabriel, G. et al., "Joint Matrices Decompositions and Blind Source Separation", 2014, IEEE Signal Processing Magazine, vol. 31, Issue:3, pp. 34-43.
Sawada, H. et al., "Blind Extraction of Dominant Target Sources Using ICA and Time-Frequency Masking", 2006, IEEE Transactions on Audio, Speech, and Language Processing, vol. 14, Issue: 6, pp. 2165-2173.
Latif, M A et. al., "Partially Constrained Blind Source Seraration for Localization of Unknown Sources Exploiting Non-homogeneity of the Head Tissues", Jul. 2007, The Journal of VLSI Signal Processing, Kluwer Academic Publishers, BO, vol. 49, No. 2, pp. 217-232.
Shinya, S. et. al., "Convolutive Blind Source Separation Using an Iterative Least-Squares Algorithm for Non-Orthogonal Approximate Joint Diagonalization", 2015, IEEE/ACM Transactions on Audio, Speech, and Language Processing, vol. 23, Issue: 12, pp. 2434-2448.
Ziehe, A. et al "A Fast Algorithm for Joint Diagonalization with Non-orthogonal Transformations and its Application to Blind Source Separation", Journal of Machine Learning Research, 2004.
Stanojevic, T. "Some Technical Possibilities of Using the Total Surround Sound Concept in the Motion Picture Technology", 133rd SMPTE Technical Conference and Equipment Exhibit, Los Angeles Convention Center, Los Angeles, California, Oct. 26-29, 1991.
Stanojevic, T. et al "Designing of TSS Halls" 13th International Congress on Acoustics, Yugoslavia, 1989.
Stanojevic, T. et al "The Total Surround Sound (TSS) Processor" SMPTE Journal, Nov. 1994.
Stanojevic, T. et al "The Total Surround Sound System", 86th AES Convention, Hamburg, Mar. 7-10, 1989.
Stanojevic, T. et al "TSS System and Live Performance Sound" 88th AES Convention, Montreux, Mar. 13-16, 1990.
Stanojevic, T. et al. "TSS Processor" 135th SMPTE Technical Conference, Oct. 29-Nov. 2, 1993, Los Angeles Convention Center, Los Angeles, California, Society of Motion Picture and Television Engineers.
Stanojevic, Tomislav "3-D Sound in Future HDTV Projection Systems" presented at the 132nd SMPTE Technical Conference, Jacob K. Javits Convention Center, New York City, Oct. 13-17, 1990.
Stanojevic, Tomislav "Surround Sound for a New Generation of Theaters, Sound and Video Contractor" Dec. 20, 1995.
Stanojevic, Tomislav, "Virtual Sound Sources in the Total Surround Sound System" Proc. 137th SMPTE Technical Conference and World Media Expo, Sep. 6-9, 1995, New Orleans Convention Center, New Orleans, Louisiana.

* cited by examiner

AUDIO SOURCE PARAMETERIZATION

TECHNICAL FIELD

The present document relates to audio content processing and more specifically to a method and system for estimating the source parameters of audio sources from mix audio signals.

BACKGROUND

Mix audio signals of multi-channel format, such as stereo signals, beamforming, 5.1 or 7.1 signals, etc., are created by mixing different audio sources in a studio, or are generated from a plurality of recordings of audio sources in a real environment. Source parameterization is a task to estimate source parameters of these audio sources for further audio processing applications. Such source parameters include information about the audio sources, such as the mixing parameters, position metadata, spectral power parameters, spectral and temporal signatures, etc. The source parameters are useful for a wide range of audio processing applications. For example, when recording an auditory scene using one or more microphones, it may be beneficial to separate and identify the audio source dependent information for different subsequent audio processing tasks. Examples for audio processing applications include spatial audio coding, 3D (three dimensional) sound analysis and synthesis and/or remixing/re-authoring. Re-mixing/re-authoring applications may render the audio sources in an extended play-back environment compared to the environment that the original mix audio signals were created for. Other applications make use of the audio source parameters to enable audio source-specific analysis and post-processing, such as boosting, attenuating, or leveling certain audio sources, for various purposes such as automatic speech recognition.

In view of the foregoing, there is a need in the art for a solution for estimating audio source parameters from mix audio signals, even if no prior information about the audio sources or about the capturing process is available (such as the properties of the recording devices, the acoustic properties of the room, etc.). Furthermore, there is a need for a robust unsupervised solution for estimating source parameters in a noisy environment.

The present document addresses the technical problem of providing a method for estimating source parameters of multiple audio sources from mix audio signals in an accurate and robust manner.

SUMMARY

According to an aspect, a method for estimating source parameters of J audio sources from I mix audio signals, with I,J>1, is described. The mix audio signals typically include a plurality of frames. The I mix audio signals are representable as a mix audio matrix in a frequency domain and the audio sources are representable as a source matrix in the frequency domain. In particular, the mix audio signals may be transformed from the time domain into the frequency domain using a time domain to frequency domain transform, such as a short-term Fourier transform.

The method includes, for a frame n, updating an un-mixing matrix which is adapted to provide an estimate of the source matrix from the mix audio matrix. The un-mixing matrix is updated based on a mixing matrix which is adapted to provide an estimate of the mix audio matrix from the source matrix. As a result of the updating step an (updated) un-mixing matrix is obtained.

In particular, an estimate of the source matrix for the frame n and for a frequency bin f of the frequency domain may be determined using $S_{fn}=\Omega_{fn}X_{fn}$. Furthermore, an estimate of the mix audio matrix for the frame n and for the frequency bin f may be determined based on $X_{fn}=A_{fn}S_{fn}$. In the above formulas, $S_{fn}$ is (an estimate of) the source matrix, $\Omega_{fn}$ is the un-mixing matrix, $A_{fn}$ is the mixing matrix, and $X_{fn}$ is the mix audio matrix.

Furthermore, the method includes updating the mixing matrix based on the (updated) un-mixing matrix and based on the I mix audio signals for the frame n.

In addition, the method includes iterating the updating steps until an overall convergence criteria is met. In other words, the un-mixing matrix may be updated using the previously updated mixing matrix and the mixing matrix may be updated using the previously updated un-mixing matrix. These updating steps may be performed for a plurality of iterations until the overall convergence criteria is met. The overall convergence criteria may be dependent on a degree of change of the mixing matrix between two successive iterations. In particular, the iterative updating procedure may be terminated once the degree of change of the mixing matrix between two successive iterations is equal to or smaller than a pre-determined threshold.

Further, the method may include determining a covariance matrix of the audio sources. The covariance matrix of the audio sources may be determined based on the mix audio matrix.

For example, the covariance matrix of the audio sources may be determined based on the mix audio matrix and based on the un-mixing matrix. The covariance matrix $R_{SS,fn}$ of the audio sources for frame n and for the frequency bin f of the frequency domain may be determined based on $R_{SS,fn}=\Omega_{fn}R_{XX,fn}\Omega_{fn}^{H}$. The un-mixing matrix may be updated based on the covariance matrix of the audio sources, thereby enabling an efficient and precise determination of the un-mixing matrix.

By repeatedly updating the mixing matrix based on the un-mixing matrix and then using the updated mixing matrix to update the un-mixing matrix, a precise mixing matrix and/or a precise un-mixing matrix may be determined, thereby enabling the determination of precise source parameters of the audio sources. For this purpose, the method may include, subsequent to meeting the convergence criteria, performing post-processing on the mixing matrix to determine one or more (additional) source parameters with regards to the audio sources (such as position information regarding the different positions of the audio sources).

The iterative procedure may be initialized by initializing the un-mixing matrix based on an un-mixing matrix determined for a frame preceding the frame n. Furthermore, the mixing matrix may be initialized based on the (initialized) un-mixing matrix and based on the I mix audio signals for the frame n. By making use of the estimation result for a previous frame for initializing the estimation method for the current frame, the convergence speed of the iterative procedure and the precision of the estimation result may be improved.

The method may include determining a covariance matrix of the mix audio signals based on the mix audio matrix. In particular, the covariance matrix $R_{XX,fn}$ of the mix audio signals for frame n and for the frequency bin f of the frequency domain may be determined based on an average of covariance matrices for a plurality of frames within a window around the frame n. By way of example, the covariance matrix of a frame k may be determined based on $X_{fk}X_{fk}^H$. The covariance matrix of the mix audio signals may be determined based on $R_{XX,fn}=\Sigma_{k=n}^{n+T-1}X_{fk}X_{fk}^H/T$, wherein T is a number of frames used for determining the covariance matrix $R_{XX,fn}$. The mixing matrix may then be updated based on the covariance matrix of the mix audio signals, thereby enabling an efficient and precise determination of the mixing matrix. Furthermore, determining the covariance matrix of the mix audio signals may comprise normalizing the covariance matrix for the frame n and for the frequency bin f such that a sum of energies of the mix audio signals for the frame n and for the frequency bin f is equal to a pre-determine normalization value (e.g. to one). By doing this, convergence properties of the method may be improved.

The method may include determining a covariance matrix of noises within the mix audio signals. The covariance matrix of noises may be determined based on the mix audio signals. Furthermore, the covariance matrix of noises may be proportional to the covariance matrix of the mix audio signals. In addition, the covariance matrix of noises may be determined such that only a main diagonal of the covariance matrix of noises includes non-zero matrix terms (to take into account the fact that the noises are uncorrelated). Alternatively or in addition, a magnitude of the matrix terms of the covariance matrix of noises may decrease with an increasing number q of iterations of the iterative procedure (thereby supporting convergence of the iterative procedure towards an optimum estimation result). The un-mixing matrix may be updated based on the covariance matrix of noises within the mix audio signals, thereby enabling an efficient and precise determination of the un-mixing matrix.

The step of updating the un-mixing matrix may include the step of improving (for example, minimizing or optimizing) an un-mixing objective function which is dependent on or which is a function of the un-mixing matrix. In a similar manner, the step of updating the mixing matrix may include the step of improving (for example, minimizing or optimizing) a mixing objective function which is dependent on or which is a function of the mixing matrix. By taking into account such objective functions, the mixing matrix and/or the un-mixing matrix may be determined in a precise manner.

The un-mixing objective function and/or the mixing objective function may include one or more constraint terms, wherein a constraint term is typically dependent on or indicative of a desired property of the un-mixing matrix or the mixing matrix. In particular, a constraint term may reflect a property of the mixing matrix or of the un-mixing matrix, which is a result of a known property of the audio sources. The one or more constraint terms may be included into the un-mixing objective function and/or the mixing objective function using one or more constraint weights, respectively, to increase or reduce an impact of the one or more constraint terms on the un-mixing objective function and/or on the mixing objective function. By taking into account one or more constraint terms, the quality of the estimated mixing matrix and/or un-mixing matrix may be increased further.

The mixing objective function (for updating the mixing matrix) may include one or more of: a constraint term which is dependent on non-negativity of the matrix terms of the mixing matrix; a constraint term which is dependent on a number of non-zero matrix terms of the mixing matrix; a constraint term which is dependent on a correlation between different columns or different rows of the mixing matrix; and/or a constraint term which is dependent on a deviation of the mixing matrix for frame n from a mixing matrix for a (directly) preceding frame.

Alternatively or in addition, the un-mixing objective function (for updating the un-mixing matrix) may include one or more of: a constraint term which is dependent on a capacity of the un-mixing matrix to provide a covariance matrix of the audio sources from a covariance matrix of the mix audio signals, such that non-zero matrix terms of the covariance matrix of the audio sources are concentrated towards the main diagonal of the covariance matrix; a constraint term which is dependent on a degree of invertibility of the un-mixing matrix; and/or a constraint term which is dependent on a degree of orthogonality of column vectors or row vectors of the un-mixing matrix.

The un-mixing objective function and/or the mixing objective function may be improved in an iterative manner until a sub convergence criteria is met, to update the un-mixing matrix and/or the mixing matrix, respectively. In other words, the updating step for updating the mixing matrix and/or for updating the un-mixing matrix may itself include an iterative procedure.

In particular, improving the mixing objective function (and by consequence updating the mixing matrix) may include the step of repeatedly multiplying the mixing matrix with a multiplier matrix until the sub convergence criteria is met, wherein the multiplier matrix may be dependent on the un-mixing matrix and on the mix audio signals. In particular, the multiplier matrix may be dependent on or may be equal to $$\left(\frac{\sqrt{D\cdot D+4(AM_+)\cdot(AM_-)}-D+\varepsilon 1}{AM_++\varepsilon 1}\right);$$

wherein $M=\Omega R_{XX}\Omega^H+\alpha_{uncorr}1$; wherein $D=-R_{XX}\Omega^H+\alpha_{sparse}1$; wherein $\Omega$ is the un-mixing matrix; wherein $R_{XX}$ is the covariance matrix of the mix audio signals; wherein $\alpha_{uncorr}$ and $\alpha_{sparse}$ are constraint weights; wherein $\varepsilon$ is a real number; and wherein A is the mixing matrix. In the above terms, the frame index n and the frequency bin index f has been omitted in order to provide a simplified notation. By repeatedly applying a multiplier matrix, the mixing matrix may be determined in a robust and precise manner.

The step of improving the un-mixing objective function (and by consequence updating the un-mixing matrix) may include repeatedly adding a gradient to the un-mixing matrix until the sub convergence criteria is met. The gradient may be dependent on a covariance matrix of the mix audio signals. Using a gradient approach, the un-mixing matrix may be updated in a precise and robust manner.

According to a further aspect, a system for estimating source parameters of J audio sources from I mix audio signals, with I,J>1 is described. The I mix audio signals are representable as a mix audio matrix in the frequency domain and the J audio sources are representable as a source matrix in the frequency domain. The system includes a parameter learner which is adapted to update an un-mixing matrix which is adapted to provide an estimate of the source matrix from the mix audio matrix, based on a mixing matrix which is adapted to provide an estimate of the mix audio matrix from the source matrix. Furthermore, the parameter learner is adapted to update the mixing matrix based on the un-mixing matrix and based on the I mix audio signals. The system is adapted to instantiate the parameter learner in a repeated manner until an overall convergence criteria is met.

According to a further aspect, a software program is described. The software program may be adapted for execution on a processor and for performing the method steps outlined in the present document when carried out on the processor.

According to another aspect, a storage medium is described. The storage medium may include a software program adapted for execution on a processor and for performing the method steps outlined in the present document when carried out on the processor.

According to a further aspect, a computer program product is described. The computer program may include executable instructions for performing the method steps outlined in the present document when executed on a computer.

It should be noted that the methods and systems including its preferred embodiments as outlined in the present patent application may be used stand-alone or in combination with the other methods and systems disclosed in this document. Furthermore, all aspects of the methods and systems outlined in the present patent application may be arbitrarily combined. In particular, the features of the claims may be combined with one another in an arbitrary manner.

BRIEF DESCRIPTION OF THE DRAWINGS

The invention is explained below in an exemplary manner with reference to the accompanying drawings, wherein.

DETAILED DESCRIPTION

Figure 1:
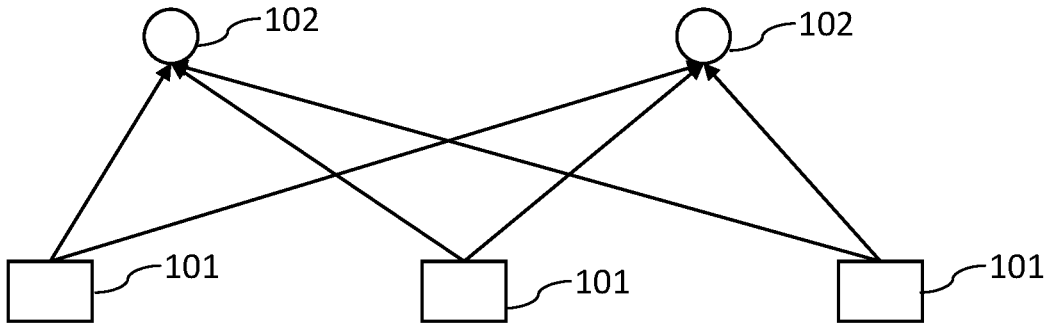
FIG. 1 shows an example scenario with a plurality of audio sources and a plurality of mix audio signals of a multi-channel signal.

As outlined above, the present document is directed at the estimation of source parameters of audio sources from mix audio signals. FIG. 1 illustrates an example scenario for source parameter estimation. In particular, FIG. 1 illustrates a plurality of audio sources 101 which are positioned at different locations within an acoustic environment. Furthermore, a plurality of mix audio signals 102 is captured by microphones at different places within the acoustic environment. It is an object of source parameter estimation to derive information about the audio sources 101 from the mix audio signals 102. In particular, an unsupervised method for source parameterization is described in the present document, which may extract meaningful source parameters, which may discover a structure underlying the observed mix audio signals, and which may provide useful representations of the given data and constraints.

The following notations are used in the present document,

A. B denotes an element-wise product of two matrices A and B;

$\frac{A}{B}$ denotes an element-wise division of two matrices A and B;

$B^{-1}$ denotes a matrix inversion of matrix B;

$B^{H}$ denotes the transpose of B if B is a real-valued matrix and denotes a conjugate transpose of B if B is a complex-valued matrix; and 1 denotes a matrix of suitable dimension with all ones.

Figure 2:
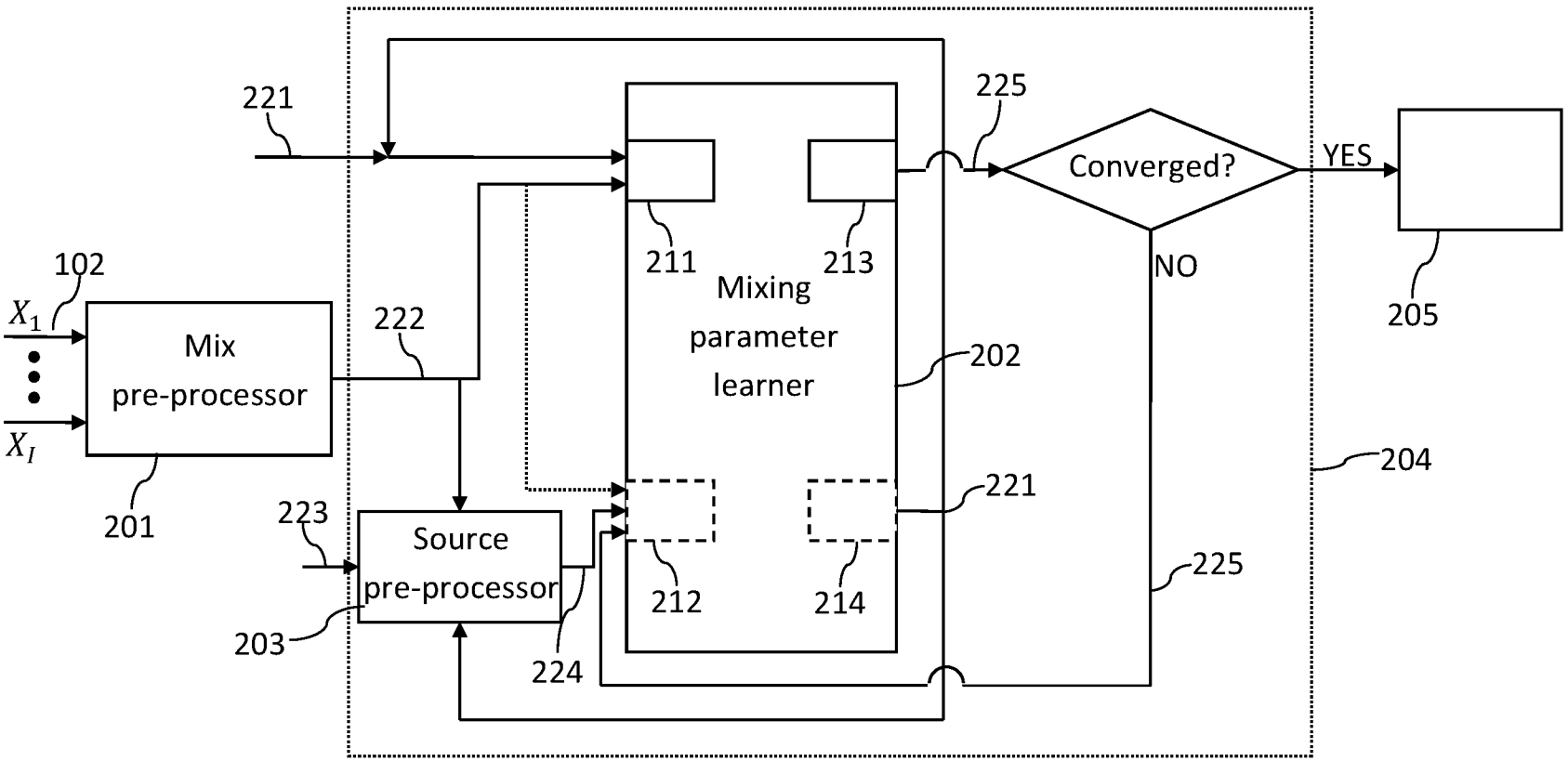
FIG. 2 shows a block diagram of an example system for estimating source parameters of a plurality of audio sources.

FIG. 2 shows a block diagram of an example system 200 for estimating a source parameter. The input of the system 200 includes a multi-channel audio signal with I audio channels or mix audio signals 102, expressed as $x_i(t)$, i=1, . . . , I, t=1, . . . Z. The mix audio signals 102 can be converted into the frequency domain, for example into the Short-time Fourier transform (STFT) domain, so that $X_{fn}$ are I×1 matrices (referred to as mix audio matrices) representing STFTs of I mix audio signals 102, with f=1, . . . , F being the frequency bin index, and with n=1, . . . , N being the time frame index. The mixing model of the mix audio signals may be presented in a matrix form as:

$$X_{fn}=A_{fn}S_{fn}+B_{fn} \tag{1}$$

where $S_{fn}$ are matrices of dimension J×1, representing STFTs of J unknown audio sources (referred to herein as source matrices), $A_{fn}$ are matrices of dimension I×J, representing mixing parameters, which can be frequency-dependent and time-varying (referred to herein as mixing matrices), and $B_{fn}$ are matrices of dimension I×1, representing additive noise plus diffusive ambience signals (referred to herein as noise matrices).

Likewise, the inverse mixing process from the observed mix audio signals 102 to the unknown audio sources 101 may be modeled in a similar matrix form as:

$$\tilde{S}_{fn}=\Omega_{fn}X_{fn} \tag{2}$$

where $\tilde{S}_{fn}$ are matrices of dimension J×1, representing STFTs of J estimated audio sources (referred to herein as estimated source matrices), $\Omega_{fn}$ are matrices of dimension J×1, representing inverse mixing parameters or un-mixing parameters (referred to herein as the un-mixing matrices).

In the present document, an unsupervised learning method and system 200 for estimating source parameters for the use in different subsequent audio processing tasks is described. Meanwhile, if prior-knowledge is available, the method and system 200 may be extended to incorporate the prior information within the learning scheme. The source parameters may include the mixing and un-mixing parameters $A_{fn}$, $\Omega_{fn}$, and/or estimated spectral and temporal parameters of the unknown audio sources 101.

The system 200 may include the following modules:

- a mix pre-processor 201 which is adapted to process the mix audio signals 102 and which outputs processed covariance matrices $R_{XX,fn}$ 222 of the mix audio signals 102.
- a mixing parameter learner 202 which is adapted to take at a first input 211 the covariance matrices 222 of the mix audio signals 102 and the un-mixing parameters $\Omega_{fn}$ 221 and to provide at a first output 213 the mixing parameters or the mixing matrix $A_{fn}$ 225. Alternatively or in addition, the mixing parameter learner 202 is adapted to take at a second input 212 the mixing parameters $A_{fn}$ 225, the output signals 224 of the source pre-processor 203 and possibly the covariance matrices 222 of the mix audio signals 102, and to provide at a second output 214 the un-mixing parameters or the un-mixing matrix$\Omega_{fn}$ 221.
- a source pre-processor 203 which is adapted to take as input the covariance matrices 222 of the mix audio signals 102 and the un-mixing parameters $\Omega_{fn}$ 201. In addition, the input may include prior knowledge 223, if available, about the audio sources 101 and/or the noises, which may be used to regulate the covariance matrices. The source pre-processor 203 outputs covariance matrices $R_{SS,fn}$ of the audio sources 101 and covariance matrices $R_{BB,fn}$ of the noises.

an iterative processor 204 which is adapted to iteratively apply modules 202 and 203 until one or more convergence criteria are met. Subsequent to convergence, the learned source parameters (for example, the mixing parameters $A_{fn}$ 225, as shown in FIG. 2) are output and possibly submitted to post-processing 205.

Table 1 illustrates example inputs and outputs of the parameter learner 202.

TABLE 1

| | Input | | Output |
|---|---|---|---|
| | Covariance matrices | Inverse mixing parameters | Mixing parameters |
| observed mix audio signals | First input: Covariance matrices output from the Mix audio pre-processor | First input: $\Omega_{fn}$: the un-mixing parameters initially set with random values or with prior information about the mix (if available) and consequently the feedback from the second output | First output: $A_{fn}$ |
| unknown audio sources | Second input: Covariance matrices output from the Source parameter regulator, and that from noise estimation | Second input: $A_{fn}$: the mixing parameters being the feedback from the first output from the parameter learner | Second output: $\Omega_{fn}$ |

In the following, examples for the different modules of the system 200 are described.

The mix pre-processor 201 may read in I mix audio signals 102 and may apply a time domain to frequency domain transform (such as a STFT transform) to provide the frequency-domain mix audio matrix $X_{fn}$. The covariance matrices $R_{XX,fn}$ 222 of the mix audio signals 102 may be calculated as below:

$$R_{XX,fn} = \Sigma_{k=n}^{n+T-1} X_{fk} X_{fk}^H / T \tag{3}$$

where n is the current frame index, and where T is the frame count of the analysis window of the transform.

In addition, the covariance matrices 222 of the mix audio signals 102 may be normalized by the energy of the mix audio signals 102 per TF tiles, so that the sum of all normalized energies of the mix audio signals 102 for a given TF tile is one:

$$R_{XX,fn} = \frac{R_{XX,fn}}{\mathrm{trace}(R_{XX,fn}) + \varepsilon_1} \tag{4}$$

where $\varepsilon_1$ is a relatively small value (for example, $10^{-6}$) to avoid division by zero, and trace(·) returns the sum of the diagonal entries of the matrix within the bracket.

The source pre-processor 203 may be adapted to calculate the audio sources' covariance matrices $R_{SS,fn}$ as:

$$R_{SS,fn} = \Omega_{fn} R_{XX,fn} \Omega_{fn}^H \tag{5}$$

It may be assumed that the noises in each mix audio signal 102 are uncorrelated to each other, which does not limit the generality from the practical point of view. Hence, the noises' covariance matrices are diagonal matrices, wherein all diagonal entries may be initialized as being proportional to the trace of mix covariance matrices of the mix audio signals 102 and wherein the proportionality factor may decrease along the iteration times of the iterative processor:

$$(R_{BB,fn})_{ii} = \frac{1}{100Q^2 I}(Q - 0.9q)^2 \mathrm{trace}(R_{XX,fn}), \tag{6}$$

where Q is the overall iteration times and q is the current iteration count during the iterative processing.

If prior knowledge 223 about the audio sources 101 and/or noises is available, advanced methods may be adopted within the source pre-processor 203.

The mixing parameter learner 202 may implement a learning method that determines the mixing and un-mixing parameters 225, 221 for the audio sources 101 by minimizing and/or optimizing a cost function (or objective function). The cost function may depend on the mix audio matrices and the mixing parameters. In an example, such a cost function for learning the mixing parameters $A_{fn}$ (or A, when omitting the frequency index f and the frame index n) may be defined as below:

$$\begin{aligned} E(A) &= \|(X^H - (AS)^H)\|_F^2 \\ &= \mathrm{trace}\big((X^H - S^H A^H)^H (X^H - S^H A^H)\big) \\ &= \mathrm{trace}(XX^H - XS^H A^H - ASX^H + ASS^H A^H) \\ &= \sum_f \mathrm{trace}\begin{bmatrix} R_{XX,fn} - R_{XX,fn}\Omega_{fn}^H A_{fn}^H - A_{fn}\Omega_{fn} R_{XX,fn}^H + \\ A_{fn}(\Omega_{fn} R_{XX,fn} \Omega_{fn}^H) A_{fn}^H \end{bmatrix} \end{aligned} \tag{7}$$

where $\|\cdot\|_F$ represents the Frobenius norm.

The cost function for learning the un-mixing parameters $\Omega_{fn}$ (or Ω) may be defined in the same manner. The input to the cost function is changed by replacing A with Ω and replacing X with S. Thus, the cost function may depend on the source matrices and the un-mixing parameters. In an example corresponding to the example of equation (7):

$$\begin{aligned} E(\Omega) &= \|(S^H - (\Omega X)^H)\|_F^2 = \\ &\sum_f \mathrm{trace}\begin{bmatrix} R_{SS,fn} - R_{SS,fn} A_{fn}^H \Omega_{fn}^H - \Omega_{fn} A_{fn} R_{SS,fn}^H + \\ \Omega_{fn}(A_{fn} R_{SS,fn} A_{fn}^H + R_{BB,fn})\Omega_{fn}^H \end{bmatrix} \end{aligned} \tag{8}$$

Alternatively, notably if the noise model is to be taken into account, a cost function using the minus log-likelihood may be used, such as:

$$\begin{aligned} E(A) &= -\log P(X_{fn} \mid A_{fn}) \\ &= \sum_f \begin{bmatrix} (X_{fn} - A_{fn} S_{fn})^H R_{BB,fn}^{-1} (X_{fn} - A_{fn} S_{fn}) + \\ \log(\mathrm{trace}|R_{BB,fn}|) \end{bmatrix} \end{aligned} \tag{9}$$

-continued $$= \sum_f \text{trace}\begin{bmatrix} R_{XX,fn} - R_{XX,fn}\Omega_{fn}^H(R_{BB,fn}^{-1}A_{fn})^H - \\ (R_{BB,fn}^{-1}A_{fn})\Omega_{fn}R_{XX,fn}^H + \\ (R_{BB,fn}^{-1}A_{fn})(\Omega_{fn}R_{XX,fn}\Omega_{fn}^H)(R_{BB,fn}^{-1}A_{fn})^H \end{bmatrix} + \sum_f \log(\text{trace}|R_{BB,fn}|)$$

$$= \sum_f \text{trace}\begin{bmatrix} R_{XX,fn} - R_{XX,fn}\Omega_{fn}^H\overline{A}_{fn}^H - \overline{A}_{fn}\Omega_{fn}R_{XX,fn}^H + \\ \overline{A}_{fn}(\Omega_{fn}R_{XX,fn}\Omega_{fn}^H)\overline{A}_{fn}^H \end{bmatrix} + \sum_f \log(\text{trace}|R_{BB,fn}|)$$

where $\overline{A}=R_{BB,fn}^{-1}A_{fn}$, and where $R_{BB,fn}$ is the covariance matrix of the noise signals. Typically, $R_{BB,fn}$ is a diagonal matrix, if the noises are considered to be uncorrelated signals. It can be observed that the cost function of equation (9) is in the same form as the cost functions of equations (7) and (8).

Different optimization techniques may be applied to learn the mixing parameters and/or un-mixing parameters. In particular, the problem of learning the mixing/un-mixing parameters may be considered as the minimization problems:

$$A=\text{argmin } E(A) \tag{10}$$

$$\Omega=\text{argmin } E(\Omega) \tag{11}$$

The system 200 may use an inverse-matrix method by solving $\nabla E=0$ to determine optimized values of the mixing parameters as follows:

$$A=R_{XX}\Omega^H(\Omega R_{XX}\Omega^H)^{-1} \tag{12}$$

$$\Omega=R_{SS}A^H(AR_{SS}A^H+R_{BB})^{-1} \tag{13}$$

The successful and efficient design and implementation of the mixing parameter learner 202 typically depends on an appropriate use of regularization, pre-processing and post-processing based on prior knowledge 223. For this purpose, one or more constraints may be taken into account within the mixing parameter learner 202, thereby enabling the extraction and/or identification of physically significant and meaningful hidden source parameters.

Figure 3:
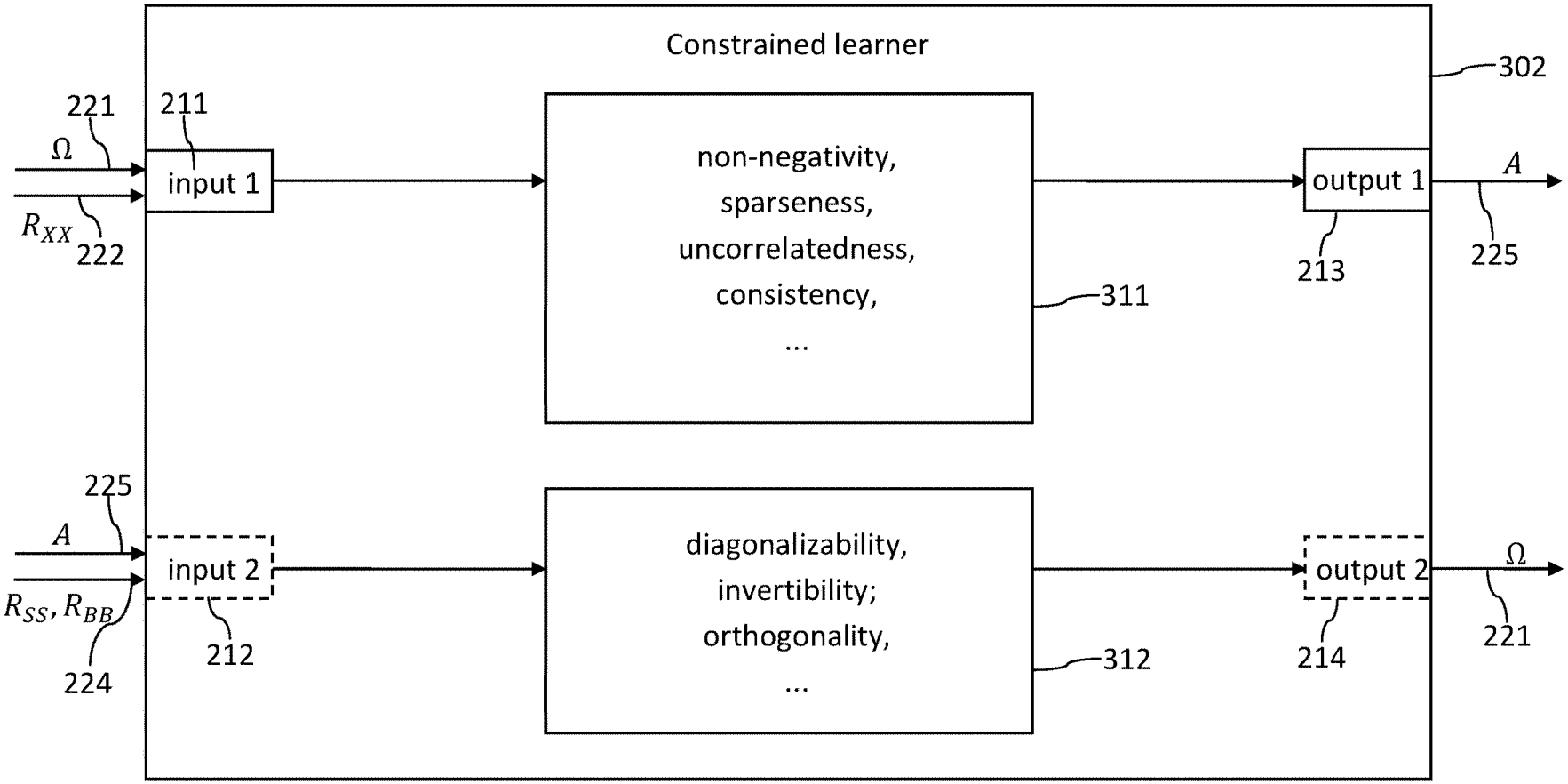
FIG. 3 shows a block diagram of an example constrained parameter learner.

FIG. 3 illustrates a mixing parameter learner 302 which makes use of one or more constraints 311, 312 for determining the mixing parameters 225 and/or for determining the un-mixing parameters 221. Different constraints 311, 312 may be imposed according to the different properties and physical meaning of the mixing parameters A and/or of the un-mixing parameters Ω.

Example constraints 311 for learning the mixing parameters A:

- A non-negativity constraint: According to a non-negativity constraint all learned mixing parameters A may be constrained to be positive value or zeros. In practice, especially for processing mix audio signals 102 created in a studio, such as movies and TV programs, it may be valid to assume that the mixing parameters A are non-negative. As a matter of fact, negative mixing parameters are rare if not impossible for content creation in a studio environment. A mixing parameter learner 202, 302 which does not make use of the non-negativity constraint may cause audible artifacts, spatial distortions and/or instability. For example, spurious out-of-phase audio sources may be generated within the system 200, if no non-negativity constraint is imposed. Such out-of-phase audio sources typically introduce audible artifacts, an energy build-up and spatial distortions when performing post processing such as up-mixing.
- Sparseness constraint: A sparseness constraint may force the mixing parameter learner 202, 203 in favor of sparse solutions of A, meaning mixing matrices A with an increased number of zero entries. This property is typically beneficial in the context of unsupervised learning, when information such as the number of audio sources 101 is unknown. For example, when the number of audio sources 101 is over-estimated (meaning, higher than the actual number of audio sources 101), the unconstrained learner 202, 302 may output a mixing matrix A which is a legitimate solution but with a number of non-zero elements that is higher than the optimal solution. Such additional non-zero elements typically correspond to spurious audio sources which may introduce instability and artifacts in the context of post processing 205. Such non-zero elements may be removed by imposing the sparseness constraint.
- Uncorrelatedness constraint: The uncorrelatedness constraint may force the parameter learner 202, 302 to be more biased towards solutions with uncorrelated columns within the mixing matrix A. This constraint may be used for screening out spurious audio sources in unsupervised learning.
- Combined sparseness and uncorrelatedness constraint: It may be beneficial for the learner 202, 302 to apply a dimension-specific sparseness constraint, which means that A is assumed to be sparse only along a first dimension rather than a second dimension. Such a dimension-specific sparseness may be achieved by imposing both the sparseness and the uncorrelatedness constraints.
- Consistency constraint: Domain knowledge indicates that the mixing matrix A typically exhibits a consistency property along time, which means that the mixing parameters of a current frame are typically consistent with the mixing parameters of a previous frame, without abrupt changes.

Moreover, for learning the un-mixing parameters Ω, one or more of the following constraints may be enforced within the learner 202, 302. Example constraints are:

- A diagonalizability constraint: A diagonalizability constraint may force the parameter learner 202, 302 to search for solutions of Ω such that the un-mixing matrix diagonalizes $R_{SS}$, which means that the diagonalizability constraint favors the estimation of the audio sources 101 to be uncorrelated to each other. The assumption of uncorrelatedness among the audio sources 101 typically enables the unsupervised learning system 200 to converge promptly to meaningful audio sources 101. That is, a respective constraint term may depend on capacity of the un-mixing matrix to provide the covariance matrix $R_{SS}$ of the audio sources from the covariance matrix $R_{XX}$ of the mix audio signals such that non-zero matrix terms of the covariance matrix of the audio sources are concentrated towards the main diagonal (e.g., the constraint term may depend on a degree of diagonality of $R_{SS}$). A degree of diagonality may be determined based on the metric A defined below.
- An invertibility constraint: The invertibility constraint regarding the un-mixing parameters may be used as a constraint which prevents the convergence of the minimizer of the cost function to a zero solution.

An orthogonality constraint: Orthogonality may be used to reduce the space within which the learner 202, 302 is operating, thereby further speeding up the convergence of the learning system 200.

While a cost function may include terms such as the Frobenius norm as expressed in equations (7) and (8) or the minus log-likelihood term as expressed in equation (9), other cost functions may be used instead of or in addition to the cost functions as described in the present document. Especially, additional constraint terms may be used to regulate the learning for fast convergence and improved performance. For example, the constrained cost function may be given by $$E(A)=\|(X^H-(AS)\|_F^2+E_{uncorr}+E_{sparse} \tag{14}$$

where $E_{uncorr}$ is a term for the uncorrelatedness constraint:

$$E_{uncorr}=\alpha_{uncorr}\|A1\|_F^2 \tag{15}$$

and $E_{sparse}$ is a term for the sparseness constraint:

$$\begin{aligned} E_{sparse} &= \alpha_{sparse}\|A\|_1 \\ &= \alpha_{sparse}\sum_{ij}|A_{ij}| \\ &= \alpha_{sparse}\sum_{ij}A_{ij}, \end{aligned} \tag{16}$$

$$\text{subject to } A_{ij} \geq 0,\ \forall\ i,\ j$$

The level of the uncorrelatedness and/or the sparsity may be increased with the increase of the regularization coefficients $\alpha_{uncorr}$ and/or $\alpha_{sparse}$. By way of example, $\alpha_{uncorr}\in[0,10]$ and $\alpha_{sparse}\in[0.0, 0.5]$.

An example constrained learner 302 may use the inverse-matrix method by solving $\nabla E=0$ to determine optimized values of the mixing parameters as follows:

$$A=(R_{XX}\Omega^H-\alpha_{sparse}1)(\Omega R_{XX}\Omega^H+\alpha_{uncorr}1)^{-1} \tag{17}$$

However, there may be limitations for the inverse-matrix method with regards to the constraints. A possible method for enforcing a non-negativity constraint is to make $A=A_+$ after each calculation of equation (17), where a positive component $A_+$ and a negative component $A_-$ of a matrix A are respectively defined as follows:

$$A_{+ij}=\begin{cases} A_{ij} & \text{if } A_{ij}>0 \\ 0 & \text{otherwise} \end{cases} \tag{18}$$

$$A_{-ij}=\begin{cases} -A_{ij} & \text{if } A_{ij}<0 \\ 0 & \text{otherwise} \end{cases}$$

Such a method for imposing non-negativity may not necessarily converge to the global optimum. On the other hand, if the non-negativity constraint is not enforced, meaning if the condition $A_{ij}\geq 0$, $\forall i,j$ in equation (16) does not hold, it may be difficult to impose the L1-norm sparseness constraint, as defined in equation (16).

Instead of or in addition to using the inverse-matrix method, an unsupervised iterative learning method may be used, which is flexible with regards to imposing different constraints. This method may be used to discover a structure underlying the observed mix audio signals 102, to extract meaningful parameters, and to identify a useful representation of the given data. The iterative learning method may be implemented in a relatively simple manner.

It may be relevant to solve the problem by multiplicative updates when constraints such as L1-norm sparseness are imposed, since a closed form solution no longer exists. Furthermore, given non-negative initialization and non-negative multipliers, the multiplicative iterative learner naturally enforces a non-negativity constraint. In addition, the multiplicative update approach also provides stability for ill-conditioned situations. It leads the learner 202 to output robust and stable mixing parameters A given ill-conditioned $\Omega R_{XX}\Omega^H$. Such an ill-conditioned situation may occur frequency for unsupervised learning, especially when the number of audio sources 101 is over-estimated, or when the estimated audio sources 101 are highly correlated to each other. In these cases, the matrix $\Omega R_{XX}\Omega^H$ is singular (having a lower rank than its dimension), so that using the inverse-matrix method in equations (12) and (13) may lead to numerical issues and may become unstable.

When using the multiplicative update approach, current values of the mixing parameters are obtained by iteratively updating previous values of the mixing parameters with a non-negative multiplier. For the purpose of illustration only, the current values of the mixing parameters may be derived from the previous values of the mixing parameters with a non-negative multiplier as follows:

$$A \leftarrow \frac{1}{2}A.\left(\frac{\sqrt{D.D+4(AM_+).(AM_-)}-D+\varepsilon 1}{AM_++\varepsilon 1}\right) \tag{19}$$

where $M=\Omega R_{XX}\Omega^H+\alpha_{uncorr}1$, $D=-R_{XX}\Omega^H+\alpha_{sparse}1$, and where $\varepsilon$ is a small value (typically $\varepsilon=10^{-8}$) to avoid zero-division. In the above, $\alpha_{sparse}$ and/or $\alpha_{uncorr}$ may be zero.

When $\alpha_{sparse}=0$ and $\alpha_{uncorr}=0$, the above mentioned updated approach is identical to an un-constrained learner without a sparseness constraint or uncorrelatedness constraint. The uncorrelatedness level and sparsity level may be pronounced by increasing the regularization coefficients or constraint weights $=_{uncorr}$ and $\alpha_{sparse}$. These coefficients may be set empirically depending on the desired degree of uncorrelatedness and/or sparseness. Typically, $\alpha_{uncorr}\in[0, 10]$ and $\alpha_{sparse}\in[0.0, 0.5]$. Alternatively, optimal regularization coefficients may be learned based on a target metric such as a signal-to-distortion ratio. It may be shown that the optimization of the cost function E (A) using the multiplicative update approach is convergent.

Although M is typically diagonalizable and positive definite, the mixing parameters obtained via the inverse-matrix method as given by equations (12) or (17) may not necessarily be positive. In contrast, when updating mixing parameter values through an update factor that is a positive multiplier according to equation (19) non-negativity in the optimization process of the mixing parameters may be ensured, provided that the initial values of the mixing parameters are non-negative. The mixing parameters obtained using a multiplicative-update method according to equation (19) may remain zero provided the initial values of the mixing parameters are zero.

The multiplicative update method may be extended for a learner 202, 302 without the non-negativity constraint, meaning that A is allowed to contain both non-negative and negative entries: $A=A_+-A_-$. For the purpose of illustration only, the current values of the mixing parameters may be derived by updating its non-negative part and negative part separately as follows:

$$A_+ \leftarrow \frac{1}{2}A_+ \cdot \left( \frac{\sqrt{D_p.D_p + 4(A_+M_+).(A_+M_-)} - D_p + \varepsilon 1}{A_+M_+ + \varepsilon 1} \right), \quad (20)$$

$$A_- \leftarrow \frac{1}{2}A_- \cdot \left( \frac{\sqrt{D_n.D_n + 4(A_-M_+).(A_-M_-)} - D_n + \varepsilon 1}{A_-M_+ + \varepsilon 1} \right),$$

where $D_p = -R_{XX}\Omega^H - A_-M + \alpha_{sparse}1$, $D_n = R_{XX}\Omega^H - A_+M + \alpha_{sparse}1$, $M = \Omega R_{XX}\Omega^H + \alpha_{uncorr}1$, and ε is a small value (typically $\varepsilon = 10^{-8}$) to avoid zero-division.

Figure 4:
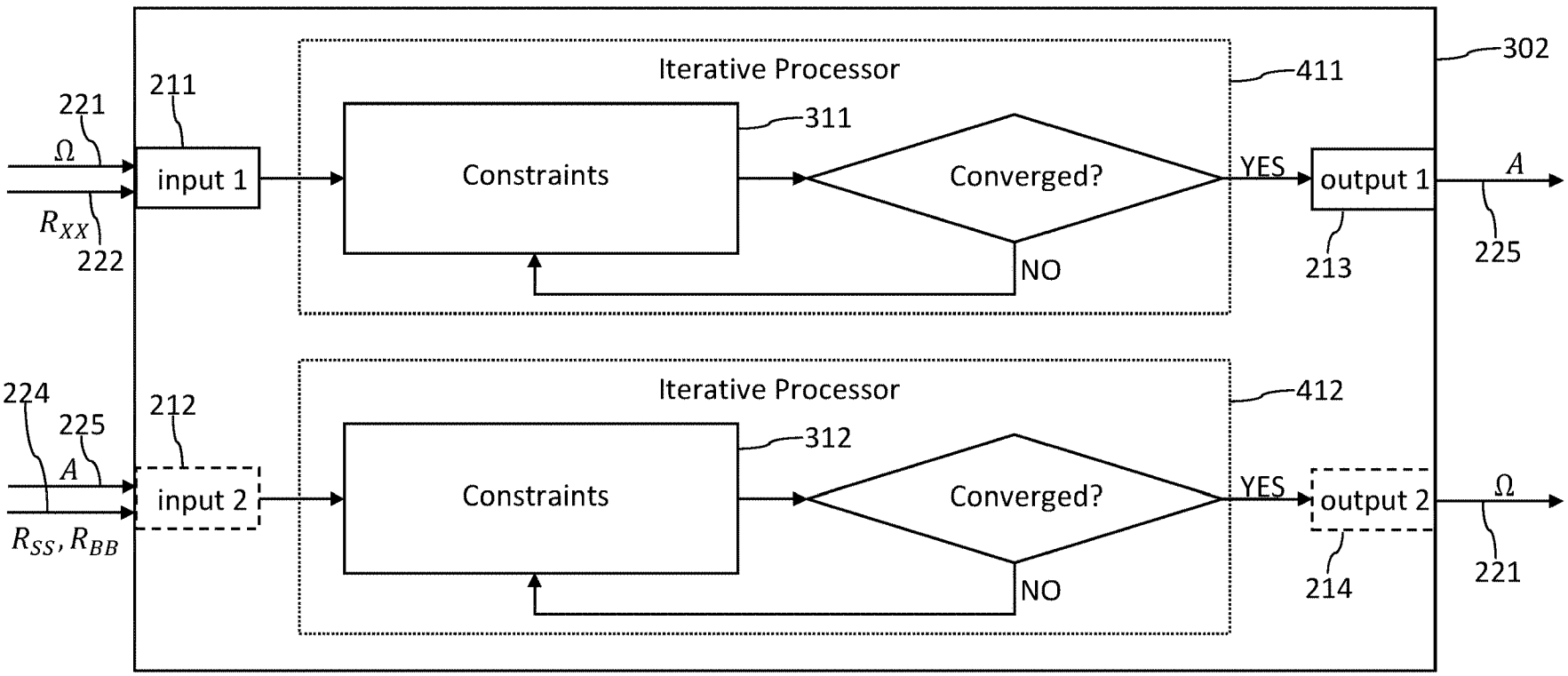
FIG. 4 shows a block diagram of another example constrained parameter learner.

As shown in FIG. 4, the constrained learner 302 may be adapted to apply an iterative processor 411 for learning the mixing parameters and an iterative processor 412 for learning the un-mixing parameters. The multiplicative-update method may be applied within the constrained learner 302. Furthermore, a different optimization method that can maintain non-negativity may be used instead of, or in conjunction with, the multiplicative-update method. In an example, a quadratic programming method (for example, implemented as MATLAB function pdco( ) etc.) that implements a non-negativity constraint may be used to learn parameter values while maintaining non-negativity. In another example, an interior point optimizer (for example, implemented in the software library IPOPT) may be used to learn parameter values while maintaining non-negativity. Such a method may be implemented as an iterative method, a recursive method, and the like. It should also be noted that such optimization methods including the multiplicative-update scheme may be applied to any of a wide variety of cost or objective functions including but not limited to the examples provided within the present document (such as the cost or objective functions given in equations (7), (8) or (9)).

Figure 5A:
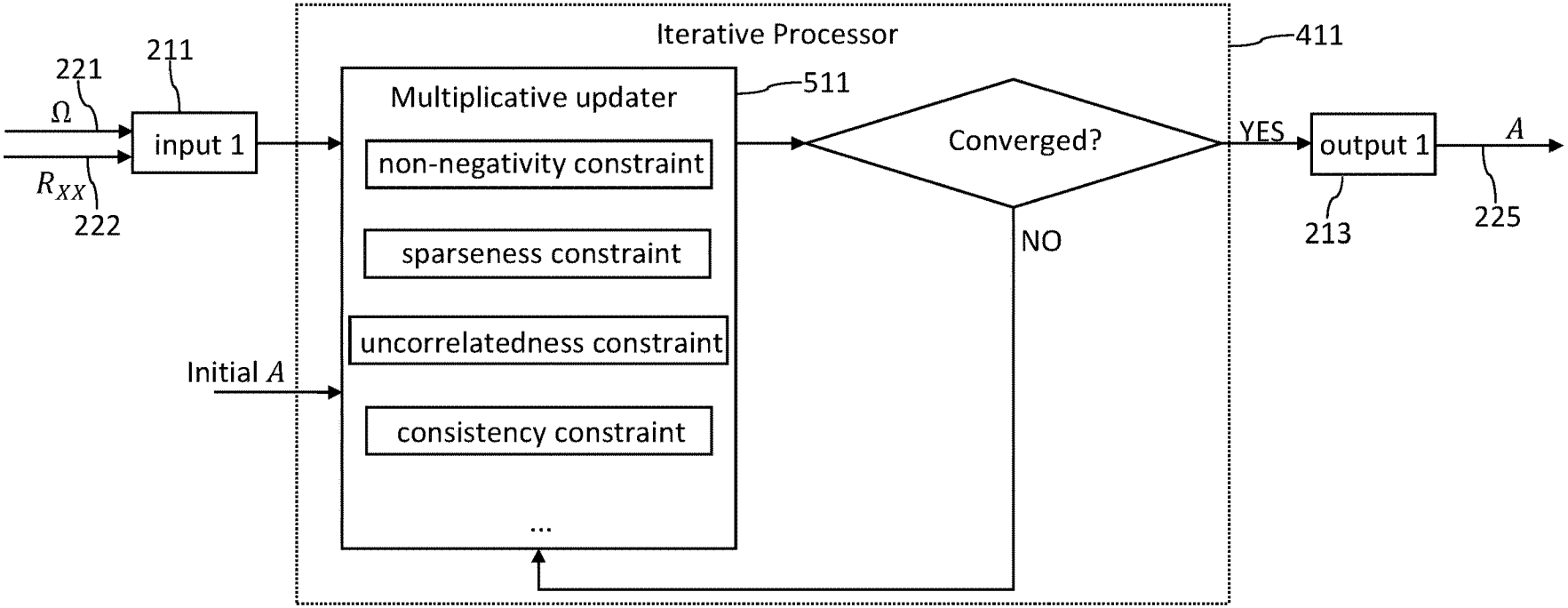
FIGS. 5A and 5B show example iterative processors for updating a mixing matrix and an un-mixing matrix, respectively.

FIG. 5A illustrates an iterative processor 411 which applies a multiplicative updater 511 iteratively. First, initial non-negative values for the mixing parameters A may be set using for example random values. Alternatively, the initial values of the mixing parameters may be inherited from values of the mixing parameters of a previous frame, $A_{fn} = A_{fn-1}$, so that the consistency constraint is indirectly imposed to the learner 302. The value of the mixing matrix A is then iteratively updated by multiplying the current values with the multiplier (as indicated for example by equation (19). The iterative procedure is terminated upon convergence. The convergence criteria (also referred to herein as sub convergence criteria) may for example include differences in values of the mixing matrix between two successive iterations. The iterative procedure may be terminated, if such differences become smaller than convergence thresholds. Alternatively or in addition, the iterative procedure may be terminated, if the maximum allowed number of iterations is reached. The iterative processor 411 may then output the converged values of the mixing parameters 225.

An example implementation of the constrained learner 302 for the mixing parameters using the multiplicative method is shown in Table 2:

TABLE 2

Input: Ω, $R_{XX}$, $A_{f,n-1}$ (if n > 1)
Initialize:
  // initialize A with learned values from previous frames; if no history data available, use random non-negative values $$A_{ij} = \begin{cases} A_{ij,f,n-1}, & \text{(if } n > 1) \\ |\phi|, \text{ where } \phi \sim \mathcal{N}(0, 1) & \text{(otherwise)} \end{cases}$$

TABLE 2-continued $M = \Omega R_{XX}\Omega^H + \alpha_{uncorr}1$,
  $D = -R_{XX}\Omega^H + \alpha_{sparse}1$,
Iteration:
  for iter = 1: iteration_times, do:
    //Update A with nonnegative multiplier using Eq. (19)
    $A_{old} = A$, $$A \leftarrow \frac{1}{2}A \cdot \left( \frac{\sqrt{D \cdot D + 4(AM_+) \cdot (AM_-)} - D + \varepsilon 1}{AM_+ + \varepsilon 1} \right),$$

//terminate the iteration if difference is less than a pre-defined threshold
    // Γ (empirically set to 0.0001)
    if $\Delta A = ||A - A_{old}||_F < \Gamma$
      break;
    end
  end
Normalize:
  for j = 1: J, do:

$$E = \sum_i A_{ij}^2$$

if $E > 10^{-12}$ $$A_{ij,fn} = \frac{A_{ij}}{\sqrt{E}} \quad \text{//L2 normalize}$$

else // if very small L2 value, set even values for the mixing parameters $$A_{ij,fn} = \frac{1}{\sqrt{I}}$$

end
  end
Output: the mixing parameters $A_{fn}$.

In the above, $\alpha_{sparse}$ and/or $\alpha_{uncorr}$ may be zero.

Figure 5B:
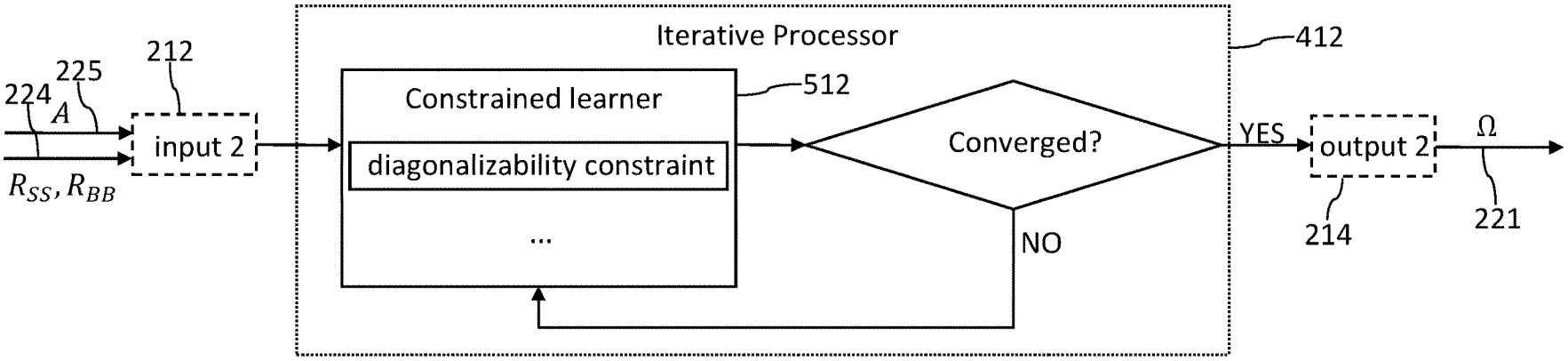

The multiplicative updater may be applied for learning un-mixing parameters Ω in a similar manner. In FIG. 5B an iterative processor 412 with a constrained learner 512 that makes use of an example gradient update method for enforcing diagonalizability is described. According to this gradient update method, a gradient may be repeatedly added to the un-mixing matrix until the sub convergence criteria is met. This may be said to correspond to improving the un-mixing objective function. The gradient may be dependent on a covariance matrix of the mix audio signals. Table 3 shows the pseudocode of such a gradient update method for determining the un-mixing parameters.

TABLE 3

Input: A, $R_{SS}$, $R_{XX}$, $R_{BB}$
Initialize:
  // initialize Ω with Example method I using Eq. (13)
  $\Omega = R_{SS}A^H (AR_{SS}A^H + R_{BB})^{-1}$,
Iteration:
  for iter = 1: iteration_times, do:
    //Update Ω by enforcing the diagonalizability constraint, where:
    //$\overline{\Delta}(\cdot)$ returns the off-diagonal matrix of the input matrix;
    // μ is the gradient learning step, and empirically μ = 2;
    // ε is a small value to avoid zero-division, and empirically $\varepsilon = 10^{-12}$ $$\Omega \leftarrow \Omega + \frac{\mu \cdot \overline{\Delta}(\Omega(R_{XX} - R_{BB})\Omega^H)\Omega R_{XX}}{||\Omega||_F^2 \cdot ||R_{XX} - R_{BB}||_F^2 + \varepsilon},$$

// Calculate a metric indicating how much the matrix is diagonalized
    $\Lambda = ||\overline{\Delta}(\Omega(R_{XX} - R_{BB})\Omega^H)||_F$ TABLE 3-continued

```
    //terminate the iteration if the target matrix is sufficiently
    diagonalized,
    where:
    //Γ1 is a threshold for absolute diagonalization degree,
    //and empirically Γ1 = 0.15;
    //Γ2 is a threshold for relative diagonalization degree descent between
    two iterations, and empirically Γ2 = 0.004;
    if Λ < Γ1 && Λold − Λ < Γ2
      break;
    end
    Λold ← Λ
  End
Output: the un-mixing parameters Ω.
```

The convergence for the iterative processor 204 in FIG. 2 may be determined by measuring the difference for the mixing parameters A between two iterations of the iterative processor 204. The difference metric may be the same as the one used in Table 2. The mixing parameters may then be output for calculating other source metadata and for other types of post-processing 205.

As such, the iterative processor 204 of FIG. 2 may make use of outer iterations for updating the un-mixing parameters based on the mixing parameters and for updating the mixing parameters based on the un-mixing parameters, in an alternating manner. Furthermore, the iterative processor 204, and notably the parameter learner 202, may make use of inner iterations for updating the un-mixing parameters and for updating the mixing parameters (using the iterative processors 412 and 411), respectively. As a result of this, the source parameters may be determined in a robust and precise manner.

In the following, example post-processing 205 is described. The audio sources' position metadata may be directly estimated from the mixing parameters A. Provided that non-negativity has been enforced when determining the mixing parameters A, each column of the mixing matrix represents the panning coefficients of the corresponding audio source. The square of the panning coefficients may represent the energy distribution of an audio source 101 within the mix audio signals 102. Thus, the position of an audio source 101 may be estimated as the energy weighted center of mass: $P_j=\Sigma_{i=1}^{I} w_{ij}P_i$, where $P_j$ is the spatial position of the j-th audio source, where $P_i$ is the position corresponding to the i-th mix audio signal 102, and where $w_{ij}$ is the energy distribution of the j-th audio source in the i-th mix audio signal:

$$w_{ij} = \frac{A_{ij}^2}{\Sigma_{i=1}^{I} A_{ij}^2}.$$

Alternatively or in addition, the spatial position of each audio source 101 may be estimated by reversing the Center of Mass Amplitude Panning (CMAP) algorithm and by using:

$$P_j = \frac{\Sigma_{i=1}^{I}\Sigma_{k=1}^{I} A_{ij}A_{kj}(1+\alpha_{distance}\delta_{i=k})P_i}{\Sigma_{i=1}^{I}\Sigma_{k=1}^{I} A_{ij}A_{kj}(1+\alpha_{distance}\delta_{i=k})} \tag{21}$$

where $\alpha_{distance}$ is a weight of a constraint term in CMAP which penalizes firing speakers that are far from the audio sources 101, and where $\alpha_{distance}$ is typically set to 0.01.

The position metadata estimated for conventional channel-based mix audio signals (such as 5.1 and 7.1 multichannel signals) typically contains 2D (two dimensional) information only (x and y since the mix audio signals only contain horizontal signals). z may be estimated with a pre-defined hemisphere function:

$$z = \begin{cases} 0, & (\text{if } a+b>1) \\ h_{max}\sqrt{1-(a+b)} & (\text{otherwise}) \end{cases} \tag{22}$$

where $$a = \frac{(0.5-x)^2}{0.5^2},\ b = \frac{(0.5-y)^2}{0.5^2}$$

are relative distances between the position of an audio source (x, y) and the center of the space (0.5, 0.5), and where $h_{max}$ is the maximum object height which typically ranges from 0 to 1.

Figure 6:
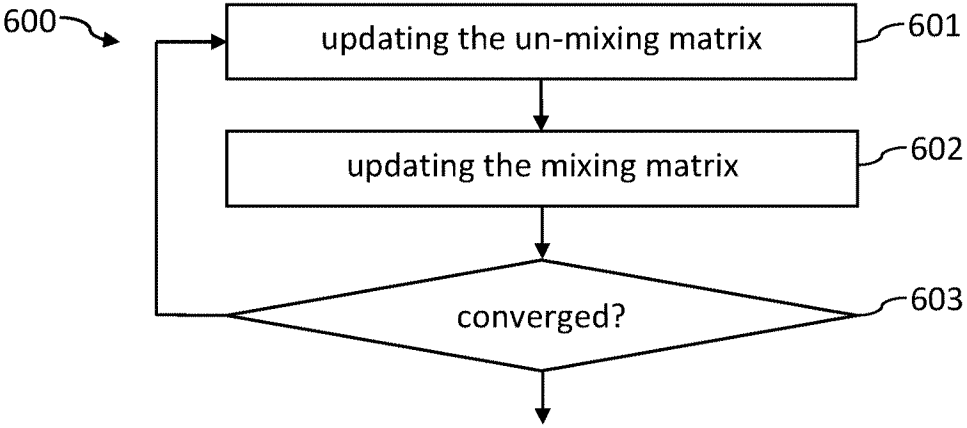
FIG. 6 shows a flow chart of an example method for estimating a source parameter of audio sources from a plurality of mix audio signals.

FIG. 6 shows a flow chart of an example method 600 for estimating source parameters of J audio sources 101 from I mix audio signals 102, with I,J>1. The mix audio signals 102 include a plurality of frames. The I mix audio signals 102 are representable as a mix audio matrix in the frequency domain and the audio sources 101 are representable as a source matrix in the frequency domain.

The method 600 includes updating 601 an un-mixing matrix 221 which is adapted to provide an estimate of the source matrix from the mix audio matrix, based on a mixing matrix 225 which is adapted to provide an estimate of the mix audio matrix from the source matrix. Furthermore, the method 600 includes updating 602 the mixing matrix 225 based on the un-mixing matrix 221 and based on the I mix audio signals 102. In addition, the method 600 includes iterating 603 the updating steps 601, 602 until an overall convergence criteria is met.

By repeatedly and alternately updating the mixing matrix 225 based on the un-mixing matrix 221 and then using the updated mixing matrix 225 to update the un-mixing matrix 221, a precise mixing matrix 225 may be determined, thereby enabling the determination of precise source parameters of the audio sources 101. The method 600 may be performed for different frequency bins f of the frequency domain and/or for different frames n.

The methods and systems described in the present document may be implemented as software, firmware and/or hardware. Certain components may for example be implemented as software running on a digital signal processor or microprocessor. Other components may for example be implemented as hardware and or as application specific integrated circuits.

The signals encountered in the described methods and systems may be stored on media such as random access memory or optical storage media. They may be transferred via networks, such as radio networks, satellite networks, wireless networks or wireline networks, for example the Internet.

Various aspects of the present invention may be appreciated from the following enumerated example embodiments (EEEs):

EEE 1. A method (600) for estimating source parameters of J audio sources (101) from I mix audio signals (102), with I,J>1, wherein the mix audio signals (102) comprise a plurality of frames, wherein the I mix audio signals (102) are representable as a mix audio matrix in a frequency domain, wherein the J audio sources (101) are representable as a source matrix in the frequency domain, wherein the method (600) comprises, for a frame n, updating (601) an un-mixing matrix (221) which is configured to provide an estimate of the source matrix from the mix audio matrix, based on a mixing matrix (225) which is configured to provide an estimate of the mix audio matrix from the source matrix;

updating (602) the mixing matrix (225) based on the un-mixing matrix (221) and based on the I mix audio signals (102) for the frame n; and iterating (603) the updating steps (601, 602) until an overall convergence criteria is met.

EEE 2. The method (600) of EEE 1, wherein the method (600) comprises determining a covariance matrix (222) of the mix audio signals (102) based on the mix audio matrix; and the mixing matrix (225) is updated based on the covariance matrix (222) of the mix audio signals (102).

EEE 3. The method (600) of EEE 2, wherein the covariance matrix $R_{XX,fn}$ (222) of the mix audio signals (102) for frame n and for a frequency bin f of the frequency domain is determined based on an average of covariance matrices of frames of the mix audio signals (102) within a window around the frame n;

the covariance matrix of a frame k is determined based on $X_{fk}X_{fk}^{H}$; and $X_{fn}$ is the mix audio matrix for frame n and for the frequency bin f.

EEE 4. The method (600) of any of EEEs 2 to 3, wherein determining the covariance matrix (222) of the mix audio signals (102) comprises normalizing the covariance matrix (222) for the frame n and for a frequency bin f such that a sum of energies of the mix audio signals (102) for the frame n and for the frequency bin f is equal to a pre-determine normalization value.

EEE 5. The method (600) of any previous EEE, wherein the method (600) comprises determining a covariance matrix (224) of the audio sources (101) based on the mix audio matrix and based on the un-mixing matrix (221); and the un-mixing matrix (221) is updated based on the covariance matrix (224) of the audio sources (101).

EEE 6. The method (600) of EEE 5, wherein the covariance matrix $R_{SS,fn}$ (224) of the audio sources (101) for frame n and for a frequency bin f of the frequency domain is determined based on $R_{SS,fn}=\Omega_{fn}R_{XX,fn}\Omega_{fn}^{H}$;

$R_{XX,fn}$ is a covariance matrix (222) of the mix audio signals (102); and $\Omega_{fn}$ is the un-mixing matrix (221).

EEE 7. The method (600) of any previous EEE, wherein the method (600) comprises determining a covariance matrix (224) of noises within the mix audio signals (102); and the un-mixing matrix (221) is updated based on the covariance matrix (224) of noises within the mix audio signals (102).

EEE 8. The method (600) of EEE 7, wherein the covariance matrix (224) of noises is determined based on the mix audio signals (102); and/or the covariance matrix (224) of noises is proportional to the trace of a covariance matrix (222) of the mix audio signals (102); and/or the covariance matrix (224) of noises is determined such that only a main diagonal of the covariance matrix (224) of noises comprises non-zero matrix terms; and/or a magnitude of the matrix terms of the covariance matrix (224) of noises decreases with an increasing number q of iterations of the method (600).

EEE 9. The method (600) of any previous EEEs, wherein updating (601) the un-mixing matrix (221) comprises improving an un-mixing objective function which is dependent on the un-mixing matrix (221); and/or updating (602) the mixing matrix (225) comprises improving a mixing objective function which is dependent on the mixing matrix (225).

EEE 10. The method (600) of EEE 9, wherein the un-mixing objective function and/or the mixing objective function comprises one or more constraint terms; and a constraint term is dependent on a desired property of the un-mixing matrix (221) or the mixing matrix (225).

EEE 11. The method (600) of EEE 10, wherein the mixing objective function comprises one or more of a constraint term which is dependent on non-negativity of the matrix terms of the mixing matrix (225);

a constraint term which is dependent on a number of non-zero matrix terms of the mixing matrix (225);

a constraint term which is dependent on a correlation between different columns or different rows of the mixing matrix (225); and/or a constraint term which is dependent on a deviation of the mixing matrix (225) for frame n and a mixing matrix (225) for a preceding frame.

EEE 12. The method (600) of any of EEEs 10 to 11, wherein the un-mixing objective function comprises one or more of a constraint term which is dependent on a capacity of the un-mixing matrix (221) to provide a covariance matrix (224) of the audio sources (101) from a covariance matrix (222) of the mix audio signals (102), such that non-zero matrix terms of the covariance matrix (224) of the audio sources (101) are concentrated towards the main diagonal;

a constraint term which is dependent on a degree of invertibility of the un-mixing matrix (221); and/or a constraint term which is dependent on a degree of orthogonality of column vectors or row vectors of the un-mixing matrix (221).

EEE 13. The method (600) of any of EEEs 10 to 12, wherein the one or more constraint terms are included into the un-mixing objective function and/or the mixing objective function using one or more constraint weights, respectively, to increase or reduce an impact of the one or more constraint terms on the un-mixing objective function and/or on the mixing objective function.

EEE 14. The method (600) of any of EEEs 9 to 13, wherein the un-mixing objective function and/or the mixing objective function are improved in an iterative manner until a sub convergence criteria is met, to update the un-mixing matrix (221) and/or the mixing matrix (225), respectively.

EEE 15. The method (600) of EEE 14, wherein improving the mixing objective function comprises repeatedly multiplying the mixing matrix (225) with a multiplier matrix until the sub convergence criteria is met; and the multiplier matrix is dependent on the un-mixing matrix (221) and on the mix audio signals (102).

EEE 16. The method (600) of EEE 15, wherein the multiplier matrix is dependent on $$\left(\frac{\sqrt{D.D+4(AM_+).(AM_-)}-D+\varepsilon 1}{AM_++\varepsilon 1}\right);$$

$M=\Omega R_{XX}\Omega^H+\alpha_{uncorr}1$;

$D=-R_{XX}\Omega^H+\alpha_{sparse}1$;

$\Omega$ is the un-mixing matrix (221);

$R_{XX}$ is a covariance matrix (222) of the mix audio signals (102);

$\alpha_{uncorr}$ and $\alpha_{sparse}$ are constraint weights;

$\varepsilon$ E is a real number; and

A is the mixing matrix (225).

EEE 17. The method (600) of any of EEEs 14 to 16, wherein improving the un-mixing objective function comprises repeatedly adding a gradient to the un-mixing matrix (221) until the sub convergence criteria is met; and the gradient is dependent on a covariance matrix (222) of the mix audio signals (102).

EEE 18. The method (600) of any previous EEEs, wherein the method (600) comprises determining the mix audio matrix by transforming the I mix audio signals (102) from a time domain to the frequency domain.

EEE 19. The method (600) of EEE 18, wherein the mix audio matrix is determined using a short-term Fourier transform.

EEE 20. The method (600) of any previous EEE, wherein an estimate of the source matrix for the frame n and for a frequency bin f is determined as $S_{fn}=\Omega_{fn}X_{fn}$;

an estimate of the mix audio matrix for the frame n and for the frequency bin f is determined based on $X_{fn}=A_{fn}S_{fn}$;

$S_{fn}$ is an estimate of the source matrix;

$\Omega_{fn}$ is the un-mixing matrix (221);

$A_{fn}$ is the mixing matrix (225); and $X_{fn}$ is the mix audio matrix.

EEE 21. The method (600) of any previous EEE, wherein the overall convergence criteria is dependent on a degree of change of the mixing matrix (225) between two successive iterations.

EEE 22. The method (600) of any previous EEE, wherein the method comprises, initializing the un-mixing matrix (221) based on an un-mixing matrix (221) determined for a frame preceding the frame n; and initializing the mixing matrix (225) based on the un-mixing matrix (221) and based on the I mix audio signals (102) for the frame n.

EEE 23. The method (600) of any previous EEE, wherein the method (600) comprises, subsequent to meeting the convergence criteria, performing post-processing (205) on the mixing matrix (225) to determine one or more source parameters with regards to the audio sources (101).

EEE 24. A storage medium comprising a software program adapted for execution on a processor and for performing the method steps of any of the previous EEEs when carried out on a computing device.

EEE 25. A system (200) for estimating source parameters of J audio sources (101) from I mix audio signals (102), with I,J>1, wherein the mix audio signals (102) comprise a plurality of frames, wherein the I mix audio signals (102) are representable as a mix audio matrix in a frequency domain, wherein the J audio sources (101) are representable as a source matrix in the frequency domain, wherein the system (200) comprises a parameter learner (202) which is configured, for a frame n, to update an un-mixing matrix (221) which is configured to provide an estimate of the source matrix from the mix audio matrix, based on a mixing matrix (225) which is configured to provide an estimate of the mix audio matrix from the source matrix; and update the mixing matrix (225) based on the un-mixing matrix (221) and based on the I mix audio signals (102) for the frame n; and the system (200) is configured to instantiate the parameter learner (202) in a repeated manner until an overall convergence criteria is met.

The invention claimed is:

1. A method of estimating source parameters of J audio sources from I mix audio signals, with I,J>1, wherein the I mix audio signals comprise a plurality of frames, wherein the I mix audio signals are represented as a mix audio matrix in a frequency domain, wherein the J audio sources are represented as a source matrix in the frequency domain, wherein the method comprises, receiving the I mix audio signals that are captured by microphones at different places within an acoustic environment;

for a frame n, updating an un-mixing matrix which is configured to provide an estimate of the source matrix from the mix audio matrix, based on a mixing matrix which is configured to provide an estimate of the mix audio matrix from the source matrix;

updating the mixing matrix based on the un-mixing matrix and based on the/mix audio signals for the frame n, by updating the mixing matrix with a non-negative multiplier multiplying previous values of the mixing matrix, wherein the non-negative multiplier is determined based at least in part on the un-mixing matrix and the I mix audio signals; and iterating the updating steps of the un-mixing matrix and the mixing matrix until an overall convergence criterion is met, wherein the method further comprises determining a covariance matrix of the audio sources;

the un-mixing matrix is updated based on the covariance matrix of the audio sources; and the covariance matrix of the audio sources is determined based on the mix audio matrix and based on the un-mixing matrix;

boosting, attenuating or leveling one or more audio sources in the J audio sources using the estimated source parameters in one or more audio processing applications, wherein the estimated source parameters include the mixing matrix.

2. The method of claim 1, wherein the method comprises determining a covariance matrix of the I mix audio signals based on the mix audio matrix; and the mixing matrix is updated based further on the covariance matrix of the I mix audio signals.

3. The method of claim 2, wherein the covariance matrix $R_{XX,fn}$ of the I mix audio signals for frame n and for a frequency bin f of the frequency domain is determined based on an average of covariance matrices of frames of the I mix audio signals within a window around the frame n;

a covariance matrix of a frame k is determined based on $X_{fk}X_{fk}^H$; and $X_{fn}$ is the mix audio matrix for frame n and for the frequency bin f.

4. The method of claim 2, wherein determining the covariance matrix of the I mix audio signals comprises normalizing the covariance matrix for the frame n and for a frequency bin f such that a sum of energies of the I mix audio signals for the frame n and for the frequency bin f is equal to a pre-determine normalization value.

5. The method of claim 1, wherein the covariance matrix $R_{SS,fn}$ of the audio sources for frame n and for a frequency bin f of the frequency domain is determined based on $R_{SS,fn}=\Omega_{fn}R_{XX,fn}\Omega_{fn}^{H}$;

$R_{XX,fn}$ is a covariance matrix of the I mix audio signals; and $\Omega_{fn}$ is the un-mixing matrix.

6. The method of claim 1, wherein the method comprises determining a covariance matrix of noises within the I mix audio signals; and the un-mixing matrix is updated based on the covariance matrix of noises within the I mix audio signals.

7. The method of claim 1, wherein a covariance matrix of noises is determined based on the I mix audio signals; and/or the covariance matrix of noises is proportional to trace of a covariance matrix of the I mix audio signals; and/or the covariance matrix of noises is determined such that only a main diagonal of the covariance matrix of noises comprises non-zero matrix terms; and/or a magnitude of the matrix terms of the covariance matrix of noises decreases with an increasing number q of iterations of the method.

8. The method of claim 1, wherein updating the un-mixing matrix comprises improving an un-mixing objective function which is dependent on the un-mixing matrix; and/or updating the mixing matrix comprises improving a mixing objective function which is dependent on the mixing matrix.

9. The method of claim 8, wherein the un-mixing objective function and/or the mixing objective function comprises one or more constraint terms; and a constraint term is dependent on a desired property of the un-mixing matrix or the mixing matrix.

10. The method of claim 9, wherein the mixing objective function comprises one or more of a constraint term which is dependent on a non-negativity of matrix terms of the mixing matrix;

a constraint term which is dependent on a number of non-zero matrix terms of the mixing matrix;

a constraint term which is dependent on a correlation between different columns or different rows of the mixing matrix; and/or a constraint term which is dependent on a deviation of the mixing matrix for frame n and a mixing matrix for a preceding frame.

11. The method of claim 9, wherein the un-mixing objective function comprises one or more of a constraint term which is dependent on a degree to which the un-mixing matrix provides a covariance matrix of the audio sources from a covariance matrix of the I mix audio signals, such that non-zero matrix terms of the covariance matrix of the audio sources are concentrated towards the main diagonal;

a constraint term which is dependent on a degree of invertibility of the un-mixing matrix; and/or a constraint term which is dependent on a degree of orthogonality of column vectors or row vectors of the un-mixing matrix.

12. The method of claim 9, wherein the one or more constraint terms are included into the un-mixing objective function and/or the mixing objective function using one or more constraint weights, respectively, to increase or reduce an impact of the one or more constraint terms on the un-mixing objective function and/or on the mixing objective function.

13. The method of claim 8, wherein the un-mixing objective function and/or the mixing objective function are improved in an iterative manner until a sub convergence criterion is met, to update the un-mixing matrix and/or the mixing matrix, respectively.

14. The method of claim 13, wherein improving the mixing objective function comprises repeatedly multiplying the mixing matrix with a multiplier matrix until the sub convergence criterion is met; and the multiplier matrix is dependent on the un-mixing matrix and on the I mix audio signals.

15. The method of claim 14, wherein the multiplier matrix is dependent on $$\left(\frac{\sqrt{D.D+4(AM_{+}).(AM_{-})}-D+\varepsilon 1}{AM_{+}+\varepsilon 1}\right);$$

$M=\Omega R_{XX}\Omega^{H}+\alpha_{uncorr}1$;

$D=-R_{XX}\Omega^{H}+\alpha_{uncorr}1$;

$\Omega$ is the un-mixing matrix;

$R_{XX}$ is a covariance matrix of the I mix audio signals;

$\alpha_{uncorr}$ and $\alpha_{sparse}$ are constraint weights;

$\varepsilon$ is a real number; and

A is the mixing matrix.

16. The method of claim 13, wherein improving the un-mixing objective function comprises repeatedly adding a gradient to the un-mixing matrix until the sub convergence criterion is met; and the gradient is dependent on a covariance matrix of the I mix audio signals.

17. The method of claim 1, wherein the method comprises determining the mix audio matrix by transforming the I mix audio signals from a time domain to the frequency domain.

18. The method of claim 17, wherein the mix audio matrix is determined using a short-term Fourier transform.

19. The method of claim 1, wherein an estimate of the source matrix for the frame n and for a frequency bin f is determined as $S_{fn}=\Omega_{fn}X_{fn}$;

an estimate of the mix audio matrix for the frame n and for the frequency bin f is determined based on $X_{fn}=A_{fn}S_{fn}$;

$S_{fn}$ is an estimate of the source matrix;

$\Omega_{fn}$ is the un-mixing matrix;

$A_{fn}$ is the mixing matrix; and $X_{fn}$ is the mix audio matrix.

20. The method of claim 1, wherein the overall convergence criterion is dependent on a degree of change of the mixing matrix between two successive iterations.

21. The method of claim 1, wherein the method comprises, initializing the mixing matrix based on an un-mixing matrix determined for a frame preceding the frame n and based on the I mix audio signals for the frame n.

22. The method of claim 1, wherein the method comprises, subsequent to meeting the convergence criterion, performing post-processing on the mixing matrix to determine one or more source parameters with regards to the audio sources.

23. A non-transitory storage medium comprising a software program that, when executed by a processor causes the processor to perform operations comprising:

receiving the I mix audio signals that are captured by microphones at different places within an acoustic environment;

estimating source parameters of J audio sources from I mix audio signals, with I,J>1, wherein the I mix audio signals comprise a plurality of frames, wherein the I mix audio signals are represented as a mix audio matrix in a frequency domain, wherein the J audio sources are represented as a source matrix in the frequency domain, the estimating comprising, for a frame n:

updating an un-mixing matrix which is configured to provide an estimate of the source matrix from the mix audio matrix, based on a mixing matrix which is configured to provide an estimate of the mix audio matrix from the source matrix;

updating the mixing matrix based on the un-mixing matrix and based on the/mix audio signals for the frame n, by updating the mixing matrix with a non-negative multiplier multiplying previous values of the mixing matrix, wherein the non-negative multiplier is determined based at least in part on the un-mixing matrix and the I mix audio signals; and iterating the updating steps of the un-mixing matrix and the mixing matrix until an overall convergence criterion is met, wherein the estimating further comprises determining a covariance matrix of the audio sources;

the un-mixing matrix is updated based on the covariance matrix of the audio sources; and the covariance matrix of the audio sources is determined based on the mix audio matrix and based on the un-mixing matrix;

boosting, attenuating or leveling one or more audio sources in the J audio sources using the estimated source parameters in one or more audio processing applications, wherein the estimated source parameters include the mixing matrix.

24. A system for estimating source parameters of J audio sources from I mix audio signals, with I,J>1, wherein the I mix audio signals comprise a plurality of frames, wherein the I mix audio signals are represented as a mix audio matrix in a frequency domain, wherein the J audio sources are represented as a source matrix in the frequency domain, wherein the system comprises a mix audio signal receiver which is configured to receive the I mix audio signals that are captured by microphones at different places within an acoustic environment;

the system comprises a parameter learner which is configured, for a frame n, to update an un-mixing matrix which is configured to provide an estimate of the source matrix from the mix audio matrix, based on a mixing matrix which is configured to provide an estimate of the mix audio matrix from the source matrix; and update the mixing matrix based on the un-mixing matrix and based on the I mix audio signals for the frame n, by updating the mixing matrix with a non-negative multiplier multiplying previous values of the mixing matrix, wherein the non-negative multiplier is determined based at least in part on the un-mixing matrix and the I mix audio signals;

the system comprises a source pre-processor which is configured to determine a covariance matrix of the audio sources;

the parameter learner is configured to update the un-mixing matrix based on the covariance matrix of the audio sources;

the system is configured to cause the parameter learner to update the mixing matrix and the un-mixing matrix in a repeated manner until an overall convergence criterion is met; and the source pre-processor is configured to determine the covariance matrix of the audio sources based on the mix audio matrix and based on the un-mixing matrix;

the system comprises an audio signal processor which is configured to boost, attenuate or level one or more audio sources in the J audio sources using the estimated source parameters in one or more audio processing applications, wherein the estimated source parameters include the mixing matrix.

* * * * *